United States Patent [19]

Rose, Jr.

[11] Patent Number: 4,793,633

[45] **Date of Patent: * Dec. 27, 1988**

[54] DEVICE FOR SUPPORTING BOUND MATERIAL

[76] Inventor: Robert D. Rose, Jr., 2635 S. Santa Fe Dr., Denver, Colo. 80223

[ * ] Notice: The portion of the term of this patent subsequent to Aug. 18, 2004 has been disclaimed.

[21] Appl. No.: 80,675

[22] Filed: Jul. 31, 1987

Related U.S. Application Data

[63] Continuation-in-part of Ser. No. 883,616, Jul. 9, 1986, which is a continuation-in-part of Ser. No. 734,959, May 16, 1985, abandoned.

[51] Int. Cl.[4] ..... B42D 3/02; G09F 5/04; B65D 73/00; A47B 41/06

[52] U.S. Cl. ..... 281/45; 40/124.4; 206/472; 248/441.1

[58] Field of Search ..... 281/3 R, 16, 20, 33, 281/45; 206/472, 454, 328; 434/405, 420, 423, 425, 429; 248/442.2; 40/124.4, 156, 159

[56] References Cited

U.S. PATENT DOCUMENTS

| | | | |
|---|---|---|---|
| 1,681,586 | 8/1928 | Kessler | 248/441.1 |
| 4,162,007 | 7/1979 | Bothun et al. | 206/454 |
| 4,250,641 | 2/1981 | Thompson | 40/159 |
| 4,291,882 | 9/1981 | Del Monte | 40/124.4 |
| 4,666,039 | 5/1987 | Corallo et al. | 206/472 |
| 4,687,226 | 8/1987 | Rose, Jr. | 281/45 |

FOREIGN PATENT DOCUMENTS

| | | | |
|---|---|---|---|
| 629588 | 12/1961 | Italy | 281/20 |

*Primary Examiner*—Frank T. Yost
*Assistant Examiner*—Paul M. Heyrana
*Attorney, Agent, or Firm*—Gregg I. Anderson

[57] ABSTRACT

A support device for bound materials, such as a notebook binder holder pages of computer software documentation, holds the bound materials in two distinct positions. In a first position, front and back covers, along free edges thereof, are received by tracks in the support device which hold the front and back covers in a substantially parallel position to each other. The support device is otherwise essentially open so that the entire spine and substantially all of the front and back covers are easily seen. In a second position, one side of the support device includes a pair of angled notches formed therein which receives lower free edges of the front and back covers. Turning the support device onto its other side, allows the user of the device to place the bound materials in the second position, supported in the notches in an open, raised or easel position for easy access and use. Means for spreading covers of the bound materials apart and into the parallel position includes a guide wall which gradually separates one cover from the other cover. The guide wall is relatively lower in height than inside walls of the device which define tracks for the free edges of the covers. Integral ramp portions of the means for receiving the covers interconnect the guide wall to the inside wall.

7 Claims, 3 Drawing Sheets

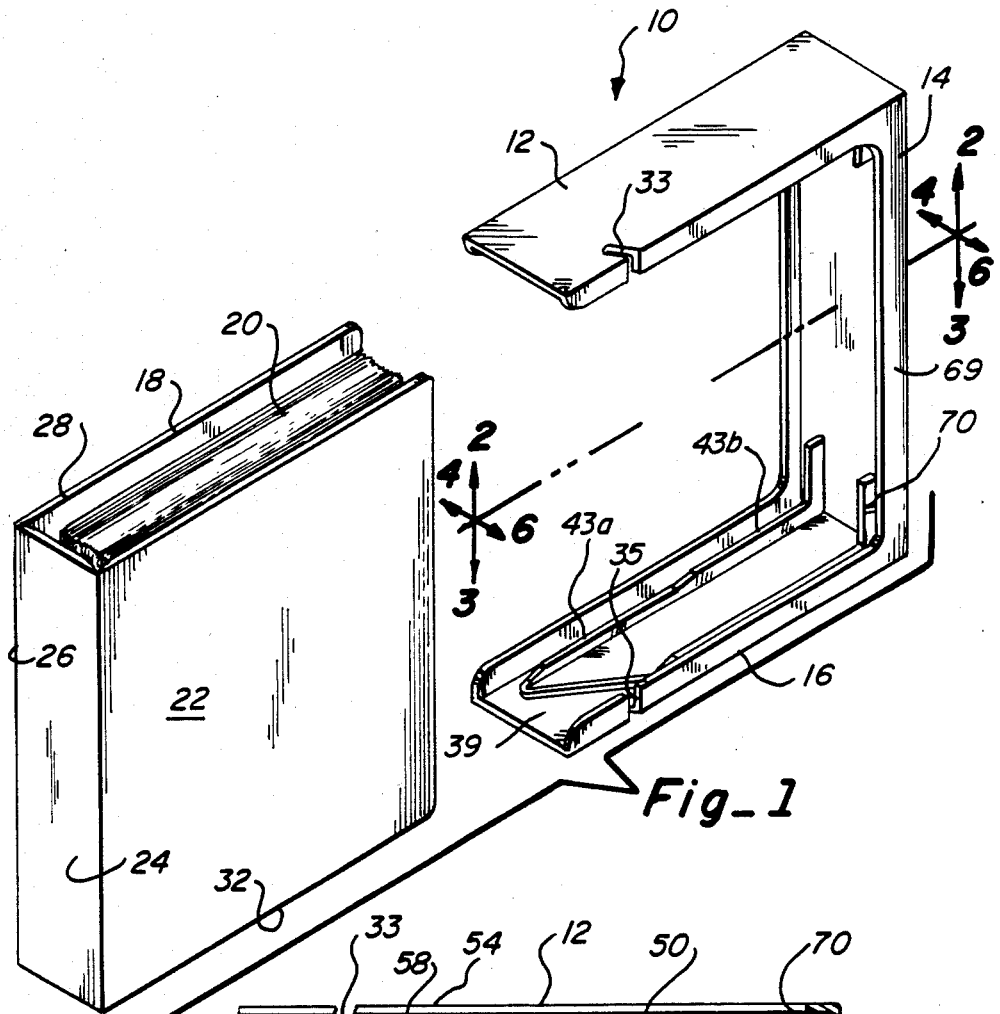
Fig_1
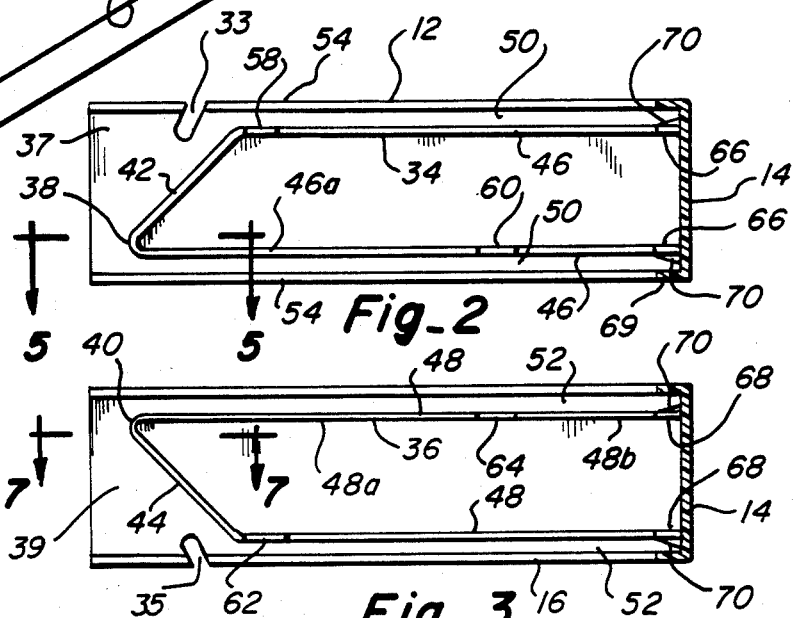
Fig_2
Fig_3

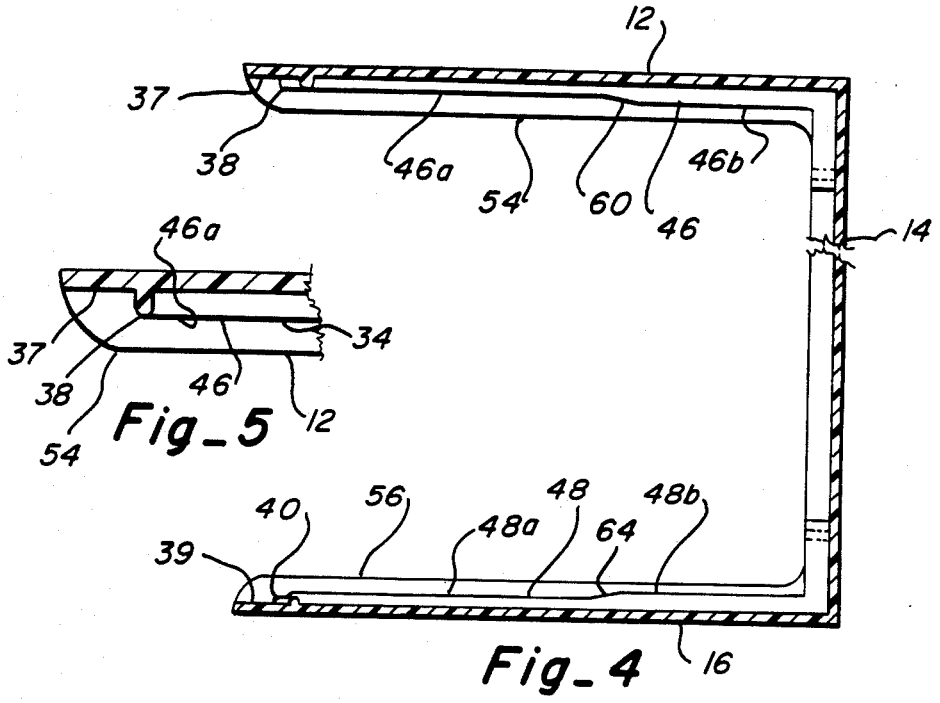
Fig_5
Fig_4
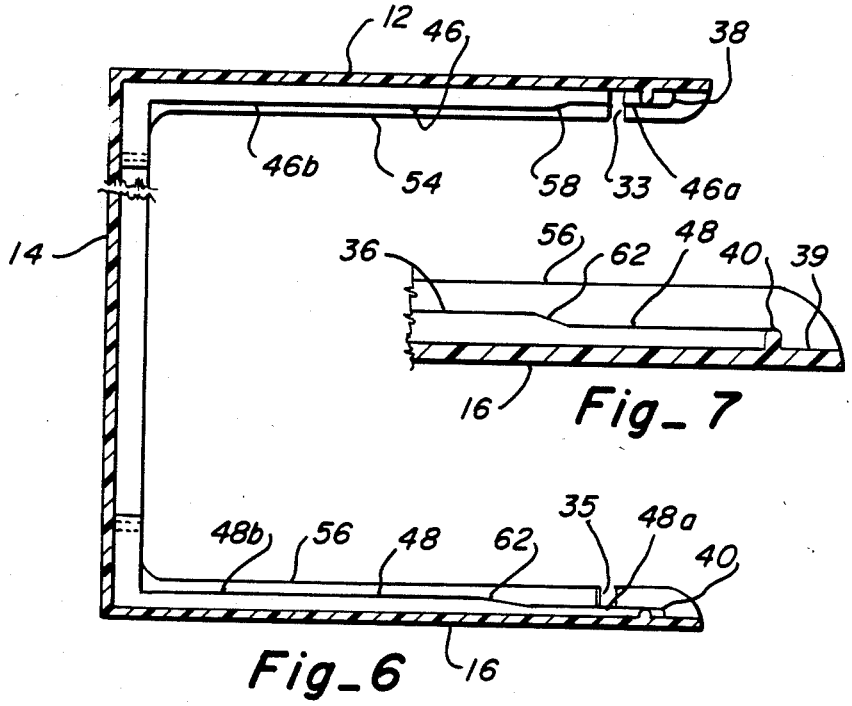
Fig_7
Fig_6

DEVICE FOR SUPPORTING BOUND MATERIAL

CROSS REFERENCE TO RELATED APPLICATIONS

This patent application is a continuation in part of U.S. patent application Ser. No. 883,616 filed July 9, 1986, which is a continuation in part of U.S. patent application Ser. No. 734,959 filed May 16, 1985, now abandoned.

BACKGROUND OF THE INVENTION

1. Field of the Invention

The present invention relates to devices for storing and protecting loose leaf pages held in a notebook binder or pages of a bound book. More particularly, the present invention relates to storage and retention of binders for written documentation and computer disks used while operating computer programs stored on the (floppy) computer disks.

2. Description of the Prior Art

As presently marketed and sold, most computer programs for business and home use include two separate parts, characterized as computer software. The first part is a magnetic medium on which a computer program is imprinted in a machine readable form. The magnetic medium, a computer or floppy disk in the case of most microcomputers, is read by the computer and loaded into computer memory. Once loaded, the program can be executed by the computer upon instructions supplied by the computer user.

The second part of computer software is written instructions used as a reference by the computer user, describing how to execute various functions of the program. These written instructions, or documentation, often in the form of loose leaf pages, are typically held in a standard three ring notebook binder including an outer cover and a retainer ring assembly, which assembly includes snap rings that open and close to receive new pages updating the written instructions. The notebook binders vary as to the amount of pages they hold. Often plastic sleeves for the floppy disks are provided which have holes to allow the user to keep the plastic sleeves secured in the binder by the rings, along with the written instructions.

The binder or book needs support in order to be shelved as one would shelve a book. Prior support devices are simply plastic, paper or linen bound slipcases which are open box-like structures which receive the binder and completely cover it leaving only the spine of the binder visible. Once sheathed in the slipcases, the binder or book can easily be shelved for storage and later reference. The slipcase further functions as a protection from dust that may damage any disks stored in the binder.

Though they are convenient, the prior art slipcases are intensive in their use of material, and therefore expensive, the entire book or binder being completely covered but for the spine. While the computer user is making reference to the pages of documentation, the slipcase is useless and must be placed somewhere out of the way. The slipcase also completely obscures any viewing of the front cover of the binder or book, which often has printed information applied thereto.

A binder for loose leaf documentation and computer disks, which displays the documentation pages, is seen in U.S. patent application Ser. No. 575,898 for Notebook for Storage of Computer Disks and Loose Leaf Documentation, the invention having common inventorship with the present invention.

Various storage cases for magnetic or floppy disks alone have heretofore been known. Examples are various patents issued to R. Egley, U.S. Pat. Nos. 4,225,038 and 4,369,879, as well as U.S. Pat. No. Des. 251,273. It is also known to store magnetic disks in thermo-formed containers, as seen in U.S. Pat. No. 3,864,755 to J. Hargis.

Composite loose leaf binders for storing written instructional materials and electronic components are seen in J. Gallaher, Jr., U.S. Pat. No. 4,157,757. Gallaher also shows compartments that can be released from the binder. Binders for storing electronic components are also seen in J. Cooper, U.S. Pat. No. 4,274,537.

A two-compartment binder is seen in U.S. Pat. No. 4,259,799 to R. Fulton, Jr. One compartment receives a notebook and the other compartment receives plastic frames. U.S. Pat. No. 3,837,680 to P. Cimini shows an overlay cover or leaf in connection with a loose leaf notebook binder which separates documents into two different binders.

Easel-type binders are seen in K. Crawford, U.S. Pat. Nos. 4,355,821; J. O'Brien, 4,033,652 and E. Petersen, 3,682,423. An easel binder showing a notebook that can be inserted into another notebook is seen in U.S. Pat. No. 3,913,740 to A. Bisberg.

An easel-type binder commercially available built along the principal shown in Crawford is also known. The commercially available binder has a fold line in the cover transverse to the binder ring assembly. The cover is folded to form an angle which supports the ring assembly at a raised or easel position.

OBJECTS AND SUMMARY OF THE INVENTION

It is the principal object of the present invention to provide a support device selectively secured to a loose leaf notebook binder or bound book which uses a minimum of material to support the binder so it can be easily shelved like a book.

It is a related object of the present invention to provide a support device selectively secured to a loose leaf notebook binder or bound book that allows easy visual reference to the front and back covers of the binder as well as the spine.

It is another object of the present invention to provide a support device for use with a loose leaf notebook binder or bound book which is convertible, when not being used to support and shelve or store the binder or book, to support the binder or book in an open raised or easel position for easy reference to the pages retained therein.

In accordance with the objects of the invention, a support device for a notebook binder or book, hereinafter reference made only to tee binder, is selectively connectable to the binder along three free edges of front and back covers of the binder, holding the front and back covers parallel to each other. This support device is open so that substantially all of the front and back covers, as well as a spine interconnecting the front and back covers, are easily seen when the support device is connected to the binder.

The support device is constructed of upper and lower members interconnected by an integral spine member, the three members extending along the free edges at the periphery of the binder cover and include interior mating tracks or slots for receipt of and positioning of the free edges of the front and back cover.

Connection of the support device to the notebook binder as just described, defines a first closed or support position. In the first closed or support position the notebook binder and mated support device form an essentially rigid structure which is easily shelved, in a manner as a conventional book. In the closed position, wherein the support device is matingly connected to the notebook binder, the entire interconnected structure rests upon the lower member of the support device and is stable in a generally upright position.

The upper and lower members include like support notches formed in one side of the support device for slideable engagement with a bottom free edge of both of the front and back covers. Once the front and back covers are engaged in the support notches of the upper and lower members, the support device is laid on its other side on a supporting surface so that the notebook binder is held at a second open raised or easel position. In the second position, the support device holds the binder open for reference to the written pages therein.

DESCRIPTION OF THE DRAWINGS

FIG. 1 is a perspective view of a support device of the present invention, a book used in conjunction with the present invention shown adjacent thereto.

FIG. 2 is a sectional view taken in the plane of line 2—2 of FIG. 1.

FIG. 3 is a sectional view taken in the plane of line 3—3 of FIG. 1.

FIG. 4 is a fragmentary sectional view taken in the plane of line 4—4 of FIG. 1.

FIG. 5 is a fragmentary sectional view taken in the plane of line 5—5 of FIG. 2.

FIG. 6 is a fragmentary sectional view taken in the plane of line 6—6 of FIG. 1.

FIG. 7 is a fragmentary sectional view taken in the plane of line 7—7 of FIG. 3.

DESCRIPTION OF THE PREFERRED EMBODIMENT

Figure 8:
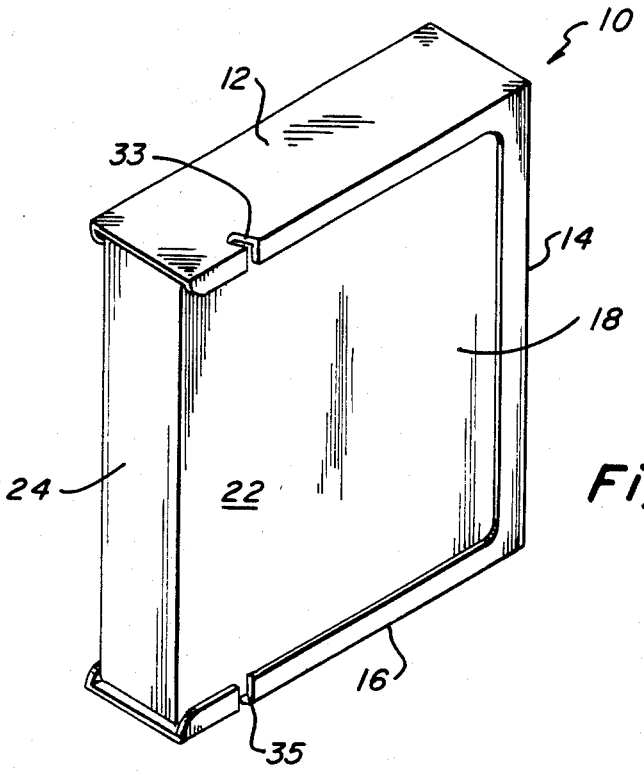
FIG. 8 is a perspective view of the support device shown in FIG. 1 and the book matably connected in a first closed support position.
Figure 9:
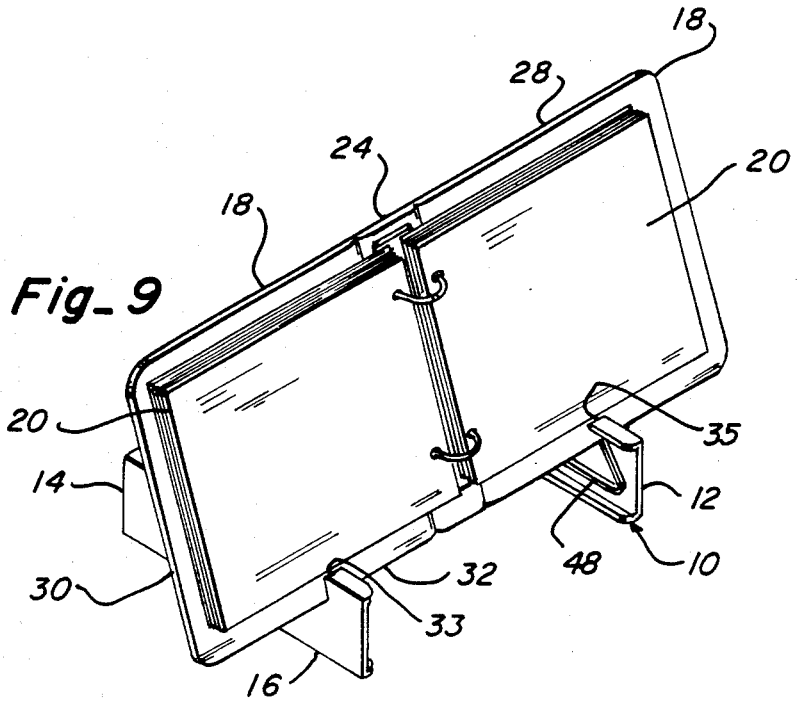
FIG. 9 is a perspective view of the support device and the book supportably connected to the support device in a second open position.

A support device 10 is seen in FIGS. 1, 4, 6, 8 and 9 to matingly connect to a binder, book or other bound material 18 in a first closed support position (FIG. 8 and a second open easel position (FIG. 9). Though the support device 10 can be used with any kind of bound material, it is preferably used, and will be described hereinafter, with a snap ring notebook binder having loose leaf pages 20, a front cover 22, a spine 24 and a back cover 26. In the first position, the loose pages 20 are held protected from dirt and other possibly damaging elements and supported in such a way that the loose leaf binder can be easily shelved like a conventional book.

In the second open easel position shown in FIG. 9, the support device 10 is laid horizontally, on one side, so that the binder 18 can be spread open and lower free edges 32 of the front and back covers 22 and 26, respectively, can be inserted into an upper support notch 33 of an upper member 12 and a lower support notch 35 of a lower member 16. This open easel position is particularly useful for displaying the contents of the binder 18, the pages 20 comprising documentation and instructions for use of a computer program. In using a computer program, it is normally advantageous for the user to have both hands free for operating a computer keyboard (not shown). With the hands free, the easel position shown in FIG. 9 permits visual reference to the loose leaf pages 20 retained in the binder 18.

In all respects, the binder 18 is a conventional, commercially-available construction in which computer software documentation is sold or later placed. The front and back covers 22 and 26, respectively, are interconnected by a spine 24. The front and back covers 22 and 26 include upper free edges 28 and forward free edges 30, as well as the lower free edges 32. The free edges 28, 30 and 32, as will be described shortly, are inserted into the support device 10 so that the upper free edge 28 follows an upper track 50 and the lower free edges 32 follow a lower track 52 of the support device. Once the binder 18 is fully inserted into the support device 10, the binder is fully protected, as seen in FIG. 8.

The support device 10 is preferably integrally constructed, as by a molding process, of high strength, yet flexible, plastic. The generally flat planar upper and lower members 12 and 16 are interconnected by a like flat planar spine member 14 to define the support device as a generally C-shaped cover (FIG. 8) for the binder 18. The support device thus defines an opening into which the binder 18 is inserted. In the first support position of FIG. 8, the upper free edges 28 slide along and are retained in the upper track 50 of the upper member 12. In like manner, the lower free edges 32 of the binder 18 are fed into the lower track 52 of the lower member 16. Finally, the forward free edge 30 of the front and back covers 22 and 26 abut against the spine member 14 and are held frictionally between wedges 70 mounted to an upper vertical inside track wall 66, a vertical inside track wall 68 and an outer wall 69 (FIGS. 2 and 3).

The binder 18 is guided into the upper and lower tracks 50 and 52 by spreading means, including an upper spreader 34 and lower spreader 36 (FIGS. 2 and 3). The spreaders 34 and 36 are generally of triangular plane view and are raised above an upper flat feed area 37 and a lower flat feed area 39, which feed areas initially receive the upper and lower free edges 28 and 32 of the binder 18. The spreaders 34 and 36 each include a separation point 38 and 40, respectively, which separation point is offset to one side of the feed areas 37 and 29. The separation points 38 and 40 penetrate the space between the front and back covers 22 and 26. The forward free edge 30 then engages upper and lower guide walls 42 and 44, respectively, as the binder is inserted into the support device. The guide walls 42 and 44 angle across the feed areas 37 and 39 toward the opposite side of the members 12 and 16 from the separation points 38 and 40. As the binder 18 is inserted into the support device, as may be seen in FIG. 1, the back cover 26 is aligned against upper and lower outside track walls 54 and 56, respectively, so that the upper and lower edges 28 and 32 are directly fed into the tracks 50 and 52. The front cover 22, as best seen in FIG. 1, engages the guide walls 42 and 44 along the free edges 30 and is spread open as the binder 18 is inserted into the support device 10.

It is noted that the tracks 50 and 52 are defined between upper and lower inside track walls 46 and 48 and the outside track walls 54 and 56. The inside track walls each include higher and lower portions 46*a* and 48*a*, respectively, which extend from the separation point along the guide walls 42 and 44 to the opposite side of the feed areas 37 and 39 to upper and lower first inclined step ramps 58 and 62. Ramp 62 is specifically shown in FIG. 7. The ramps 58 and 62 raise upwardly terminating in upper and lower higher portions 46*b* and 48*b*, respectively, of the inside track walls 46 and 48.

On the opposite side of tee track walls 46 and 48, the lower portions 46*a* and 48*a* extend slightly more than halfway along the entire length of the track walls 46 and 48 ending at upper and lower second step ramps 60 and 64, respectively.

The lower portions 46*a* and 48*a* are approximately one-sixteenth of an inch high above the feed areas 37 and 39. The higher portions 46*b* and 48*a* are approximately one-quarter of an inch above the upper and lower tracks 50 and 52, which track areas are co-planar with the feed areas 37 and 39. Thus, the step ramps 58, 60, 62 and 64 raise the track walls 46 and 48 approximately one-eighth of an inch over their linear length of approximately one-quarter of an inch. The vertical track walls 68 and 66 are about five-sixteenths of an inch above the planar area on the inside surface of the spine member 14.

In operation, as the binder 18 is inserted in the configuration shown in FIG. 1, the back cover 26 is aligned with and along the outer track walls 54 and 56. The forward free edge 30 of the back cover 26 passes the separation points 38 and 40 and enters the upper and lower tracks 50 and 52. The forward free edge 30 of the front cover 22 engages the guide walls 42 and 44 and is spread away from the free edge 30 of the back cover 26. At the termination of the lower portions 46*a* and 48*a*, the front cover 22 enters the upper and lower tracks 50 and 52 at the ramp positions 58 and 62. The pages 20, because of the relatively lower height of the lower portions 46*a* and 48*a*, are less likely to interfere with the spreading of the front cover 22 from the back cover 26. The ramps 58 and 62 help guide the front cover 22 into the tracks 50 and 52 while also making sure the pages 20 are fed from the lower portions 46*a* and 48*a* to the higher portions 46*b* and 48*b* and are not interfered with by the guide walls 42 and 44.

As the book binder 18 is further inserted into the support device 10, the back cover 26 and the free edges 28, 30 and 32 associated therewith encounter the second step ramps 60 and 64, and once inserted beyond that point, the back cover 26 is firmly secured between the walls 48*a* and *b* and 54 and 56, respectively.

As has been previously referenced, as the forward free edges 30 are pushed into abutment with the inside surface of the spine member 14, the wedges 70 frictionally contact the free edge and force it into contact with the outer wall 69 of the spine member, thereby securing the binder 18 in the support device 10 in the closed position.

As has previously been discussed, the notches 33 and 35 receive the lower free edges 32 of the front and back covers 22 and 26 to thereby hold the binder 18 in the second open easel position.

Though the invention has been described with a certain degree of particularity, the scope of the invention is set out in the appended claims.

What is claimed is:

1. A support device for bound materials including a front and back cover interconnected by a spine, said device comprising in combination:

a generally C-shaped frame, including an upper member, a spine member and a lower member, each of said members having tracks formed therein for receiving free edges of said front and back covers and for holding said front and back covers in a pre-established, fixed position wherein said bound materials are completely enclosed and said covers are positioned by said tracks essentially parallel to each other, said tracks of said upper and lower members defined by an outside wall and an inside wall, at least one of said inside walls including an integral guide wall, said guide wall extending angularly from one of said inside and outside walls to the other, defining with one of said walls a separation point which is insertable between said front and back covers of said bound materials.

2. The invention as defined in claim 1 wherein the portion of said guide wall opposite from the separation point terminates in an inclined ramp contiguous with said inside wall, said inside wall is relatively higher than said guide wall.

3. The invention as defined in claim 2 wherein the inside wall opposite said ramp includes a lower portion and a higher portion, said lower portion adjacent to said separation point and said higher portion continuous with said lower portion through a second ramp.

4. The invention as defined in claim 3 wherein said spine member further includes vertical inside walls having means for frictionally grasping free edges of said front and back covers of said bound materials.

5. The invention as defined in claim 1 wherein each of said upper and lower members include notches formed therein to receive lower free edges of the front and back covers of said bound materials to hold said bound materials in an open raised easel position.

6. A support device for bound materials including a front cover and a back cover interconnected by a spine, said support device comprising in combination:

means for receiving and rigidly holding said front and back covers in a pre-established position, said means for receiving said covers mateable to free edges of said front and back covers, said means for receiving said covers further including an enlarged, open mouth offset to one side of said support device wherein one of said front or back covers is inserted into a track of said support device between an outer wall and an inner wall, and the other of said front and back covers of said bound materials engages guide means of said means for receiving said covers, said guide means for spreading said other of said front and back covers away from the one of said front and back covers to a position substantially parallel with the one of said front and back cover and into a track of said support device.

7. A support device for bound materials having a cover, said cover including a front cover interconnected by a spine to a back cover, said support device being of generally C-shaped configuration, including three intersecting straight planar members, an upper member interconnected to a lower member by a spine member, a track formed along two sides of at least a portion of the length of each of said three members for mating receipt of corresponding edges of the front and back covers of said bound materials, and means for receiving said bound materials including a guide wall for moving one of said front and back covers to a position substantially parallel to the other of said front and back covers and into said tracks, said guide wall being of a relatively lower height than an inside wall defining said track.

* * * * *